US010800636B2

(12) United States Patent
Mikkonen et al.

(10) Patent No.: US 10,800,636 B2
(45) Date of Patent: Oct. 13, 2020

(54) ELEVATOR

(71) Applicants: Janne Mikkonen, Jarvenpaa (FI); Jorma Mustalahti, Hyvinkaa (FI); Veijo Manninen, Helsinki (FI)

(72) Inventors: Janne Mikkonen, Jarvenpaa (FI); Jorma Mustalahti, Hyvinkaa (FI); Veijo Manninen, Helsinki (FI)

(73) Assignee: Kone Corporation, Helsinki (FI)

( * ) Notice: Subject to any disclaimer, the term of this patent is extended or adjusted under 35 U.S.C. 154(b) by 207 days.

(21) Appl. No.: 15/609,507

(22) Filed: May 31, 2017

(65) Prior Publication Data

US 2017/0362056 A1 Dec. 21, 2017

(30) Foreign Application Priority Data

Jun. 15, 2016 (EP) ..... 16174565

(51) Int. Cl.

| | |
|---|---|
| ***B66B 5/28*** | (2006.01) |
| ***B66B 5/16*** | (2006.01) |
| ***B66B 11/02*** | (2006.01) |
| ***B66B 7/02*** | (2006.01) |
| ***B66B 5/00*** | (2006.01) |
| ***B66B 9/00*** | (2006.01) |

(52) U.S. Cl.

CPC ..... *B66B 5/282* (2013.01); *B66B 5/0075* (2013.01); *B66B 5/16* (2013.01); *B66B 5/28* (2013.01); *B66B 7/027* (2013.01); *B66B 9/00* (2013.01); *B66B 11/0226* (2013.01)

(58) Field of Classification Search

CPC ..... B66B 5/28; B66B 5/282; B66B 5/0056; B66B 5/0068; B66B 5/0075; B66B 5/0062; B66B 7/027

See application file for complete search history.

(56) References Cited

U.S. PATENT DOCUMENTS

| | | | | |
|---|---|---|---|---|
| 3,815,959 | A * | 6/1974 | Hill | B60B 27/0005 301/5.306 |
| 4,333,549 | A * | 6/1982 | Davis | B66B 5/22 187/377 |
| 5,370,207 | A * | 12/1994 | Hongo | B66B 5/22 187/343 |
| 7,413,060 | B2 * | 8/2008 | Takashi | B66B 5/0075 187/351 |
| 8,453,800 | B2 | 6/2013 | Tolonen | |

(Continued)

FOREIGN PATENT DOCUMENTS

| | | |
|---|---|---|
| EP | 1916214 A1 | 4/2008 |

OTHER PUBLICATIONS

Extended European Search Report EP16174565 dated Dec. 8, 2016.

*Primary Examiner* — Diem M Tran

(74) *Attorney, Agent, or Firm* — Harness, Dickey & Pierce, P.L.C.

(57) ABSTRACT

The elevator comprises guide rails extending along a height of a shaft, a car and/or a counterweight moving upwards and downwards in the shaft and being glidingly supported on the guide rails. A stop block is attached to at least one guide rail in order to prevent movement of the car and/or the counterweight beyond the level of the stop block. The stop block comprises a buffer attached to a bottom plate. The buffer comprises a slot receiving a guide portion of the guide rail. The bottom plate supports the buffer on the guide rail.

17 Claims, 8 Drawing Sheets

(56) References Cited

U.S. PATENT DOCUMENTS

| | | | | |
|---|---|---|---|---|
| 8,479,889 | B2 * | 7/2013 | Taavela | B66B 5/28 187/344 |
| 2005/0276586 | A1 | 12/2005 | Thweatt | |
| 2005/0279586 | A1 * | 12/2005 | Maury | B66B 5/282 187/359 |
| 2007/0205058 | A1 * | 9/2007 | Caballero | B66B 5/005 187/306 |
| 2009/0183955 | A1 * | 7/2009 | Gonzalez Rodil | B66B 5/0081 187/404 |

* cited by examiner

ELEVATOR

FIELD OF THE INVENTION

This application claims priority to European Patent Application No. EP16174565.8 filed on Jun. 15, 2016, the entire contents of which are incorporated herein by reference.

The invention relates to an elevator comprising guide rails extending along a height of a shaft, a car and/or a counterweight moving upwards and downwards in the shaft and being glidingly supported on the guide rails. A stop block is attached to at least one guide rail in order to prevent movement of the car and/or the counterweight beyond the level of the stop block.

BACKGROUND ART

An elevator comprises typically a car, an elevator shaft, a machine room, lifting machinery, ropes, and a counter weight. The elevator car may be positioned within a sling that supports the car. The lifting machinery may be positioned in the machine room and may comprise a drive, an electric motor, a drive pulley, and a machinery brake. The lifting machinery may move the car in a vertical direction upwards and downwards in the vertically extending elevator shaft. The ropes may connect the sling and thereby also the car via the drive pulley to the counter weight. The sling may further be supported with gliding means on guide rails extending along the height of the shaft. The guide rails may be supported with fastening brackets on the side wall structures of the shaft. The gliding means may engage with the guide rails and keep the car in position in the horizontal plane when the car moves upwards and downwards in the elevator shaft. The counter weight may be supported in a corresponding way on guide rails supported on the wall structure of the shaft. The elevator car may transport people and/or goods between the landings in the building. The elevator shaft may be formed so that the wall structure is formed of solid walls or so that the wall structure is formed of an open steel structure. The lower portion of the shaft may form a pit.

Stop arrangements may be used for restricting the movement of the car beyond a certain level in the shaft. The following prior art applications disclose some examples of stop arrangements.

US patent application 2005/0279586 discloses shaft pit equipment for an elevator. The shaft pit arrangement connects a guide rail and a buffer support with a plate that produces a stiff unit of the buffer support and the guide rail. The plate has a rectangular recess that fits on the narrow side of the guide rail. The plate can be pushed onto a free limb of the guide rail. The recess has on both sides of the free limb an offset that serves for conducting away the lubrication oil, wherein the lubrication oil passes into a lubrication oil connector below the plate. In addition, the plate has in the rail region a bent-over portion at which a screw is arranged.

U.S. Pat. No. 8,453,800 discloses an elevator and stop block arrangement for an elevator. The elevator comprises an elevator car, car guide rails on one side of the elevator car, an elevator shaft, at least one stop block attached to the car guide rail, at least two movable stop blocks attached to the car. The at least two movable stop blocks can be turned around a pivot point between two positions. The movable stop blocks are in a first position aligned with the at least one stop block so that the car stops against the at least one stop block. The movable stop blocks are in the second position turned away from the at least one stop block so that the car can pass beyond the at least one stop block.

BRIEF DESCRIPTION OF THE INVENTION

An object of the present invention is an elevator with an improved stop arrangement.

The elevator according to the invention is defined in claim 1.

The elevator comprises guide rails extending along a height of a shaft, a car and/or a counterweight moving upwards and downwards in the shaft and being glidingly supported on the guide rails, a stop block being attached to at least one guide rail in order to prevent movement of the car and/or the counterweight beyond the level of the stop block. The stop block comprises a buffer attached to a bottom plate, the buffer comprising a slot receiving a guide portion of the guide rail, whereby the guide portion of the guide rail becomes enclosed within the buffer, the bottom plate supporting the buffer on the guide rail.

The use of a stop block comprising a buffer and a bottom plate as defined in claim 1 results in a compact and efficient stop block arrangement.

The space between the car guide rails remains free in the pit as no separate support bars for buffers are needed in said space. The safety regulations require that when the car is at its lowest position, at least one clear space where a refuge space can be accommodated, shall be provided on the pit floor. The increased free space under the car makes it easy to arrange the refuge space under the car.

The buffer is attached directly to the guide rails which eliminates the need of separate support arrangements for the buffers. There is thus no need to attach separate support bars to the floor of the pit, which means that there is no need to brake the water isolation of the floor of the pit.

The vertical forces acting on the buffer can be directed to the floor of the pit via the guide rails.

The position of the buffers on the guide rail results in smaller lateral forces acting on the car during a stop against the buffers. It might thus be possible to use smaller guide rails.

The emergency clutch and the gliding means are positioned in the vicinity of the guide rails. This means that the car comprises stiff frame structures in the vicinity of the guide rails. The counter plate of the buffer can thus easily be attached to these stiff frame constructions in the car in the vicinity of the guide rails.

The free space is limited in the pit in an elevator having the lifting machinery positioned in a lifting station at the bottom of the pit. The buffer of the car guide rail situated on same side of the shaft as the lifting station may be supported on the same bracket as the car guide rail.

Safety regulations require that when the car is at the lowest position, there must be a minimum free vertical distance between the bottom of the pit and the lowest parts of the car. This minimum free vertical distance is 0.50 m. This minimum free vertical distance may be reduced for car frame parts, safety gears, guide shoes and pawl devices, within a maximum horizontal distance from the guide rails. The minimum value for this free vertical distance is 0.1 m for car parts within a maximum horizontal distance of 0.15 m from the guide rails. This free vertical distance increases linearly from 0.1 m to 0.3 m when the maximum horizontal distance increases from 0.15 to 0.3 m and again linearly from 0.3 m to 0.5 m when the maximum horizontal distance increases from 0.3 to 0.5 m. The free vertical distance is, however, not needed between the counter plate in the car and the buffer. The lowest parts of the car near the guide rail will in the invention be the counter plate attached to the car and seating against the upper surface of the buffer when the car hits the buffer. The pit can thus be lower because the minimum free vertical distance of 0.1 m is no longer needed.

The collection of lubrication medium may be integrated into the stop block arrangement.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
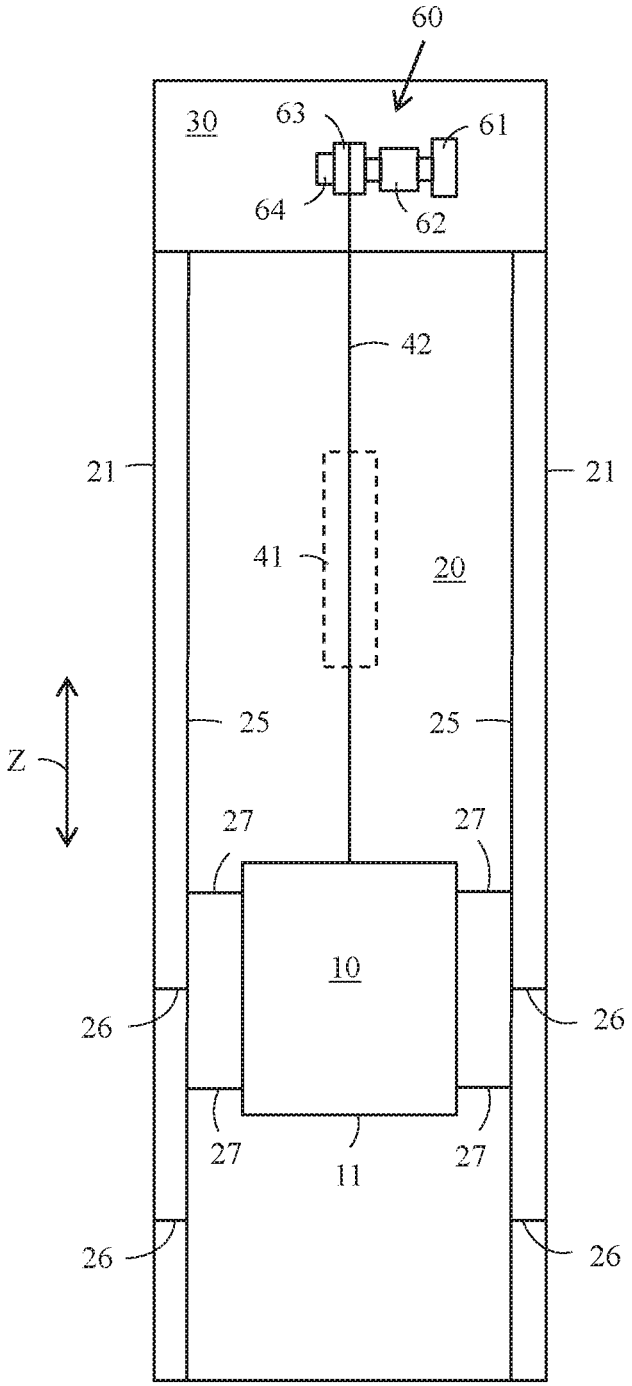
FIG. 1 shows a vertical cross section in the side to side direction of a first embodiment of an elevator.

FIG. 1 shows a vertical cross section in the side to side direction of a first embodiment of an elevator. The elevator comprises a car 10, an elevator shaft 20, a machine room 30, lifting machinery 60, ropes 42, and a counter weight 41. A separate or an integrated sling 11 may surround the car 10.

The lifting machinery 60 positioned in the machine room 30 may comprise a drive 61, an electric motor 62, a drive pulley 63, and a machinery brake 64. The lifting machinery 60 moves the car 10 in a vertical direction Z upwards and downwards in the vertically extending elevator shaft 20. The machinery brake 64 stops the rotation of the drive pulley 63 and thereby the movement of the elevator car 10.

The sling 11 is connected by the ropes 42 via the drive pulley 63 to the counter weight 41. The sling 11 is further supported with gliding means 27 at guide rails 25 extending in the vertical direction in the shaft 20. The gliding means 27 can comprise rolls rolling on the guide rails 25 or gliding shoes gliding on the guide rails 25 when the car 10 is moving upwards and downwards in the elevator shaft 20. The guide rails 25 are attached with fastening brackets 26 to the side wall structures 21 in the elevator shaft 20. The gliding means 27 keep the car 10 in position in the horizontal plane when the car 10 moves upwards and downwards in the elevator shaft 20. The counter weight 41 is supported in a corresponding way on guide rails that are attached to the wall structure 21 of the shaft 20.

The car 10 transports people and/or goods between the landings in the building. The elevator shaft 20 can be formed so that the wall structure 21 is formed of solid walls or so that the wall structure 21 is formed of an open steel structure.

Figure 2:
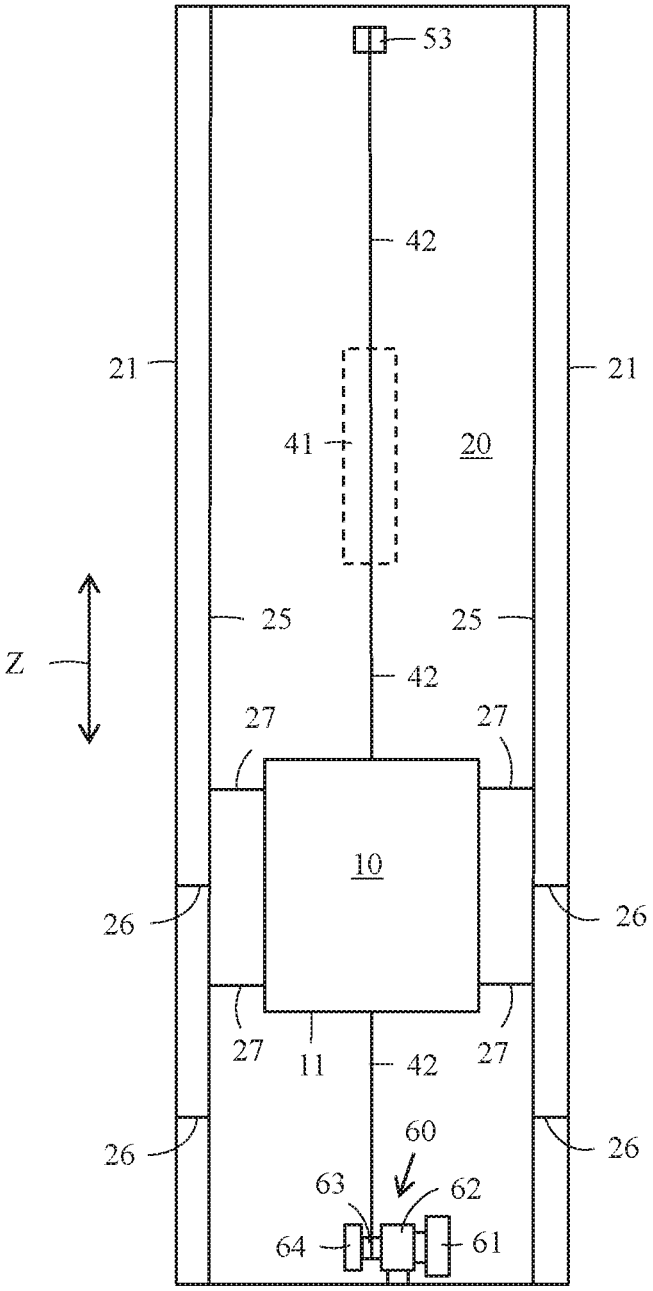
FIG. 2 shows a first vertical cross section in the side to side direction of a second embodiment of an elevator.
Figure 3:
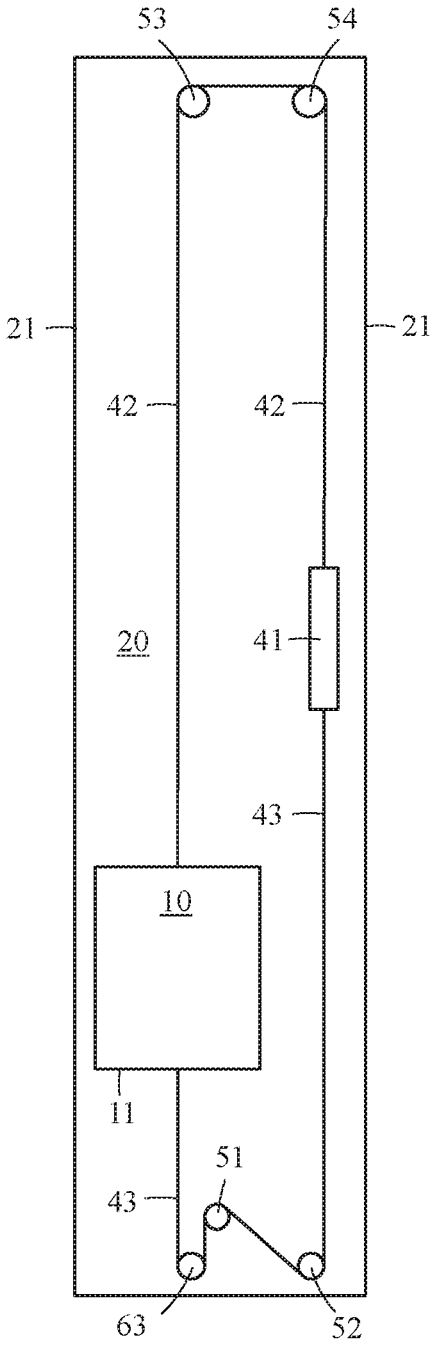
FIG. 3 shows a second vertical cross section in the front to back direction of the second embodiment of an elevator.

FIG. 2 shows a first vertical cross section in the side to side direction and FIG. 3 a second vertical cross section in the back to front direction of a second embodiment of an elevator. This second embodiment differs from the first embodiment in that the lifting machinery is positioned at the bottom of the shaft. The elevator comprises a car 10, an elevator shaft 20, lifting machinery 60, a counter weight or balancing weight 41, and transmission means 42, 43. A separate or an integrated sling 11 may surround the car 10. The lifting machinery 60 at the bottom of the shaft 20 may comprise a drive 61, an electric motor 62, a drive pulley 63, and a machinery brake 64.

The transmission means 42, 43 may comprise an upper suspension rope 42 and a lower traction belt 43. The upper suspension rope 42 passes from a top of the car 10 over upper deflection pulleys 53, 54 to a top of the counter weight 41. The lower traction belt 43 passes from a bottom of the car 10 over the drive pulley 63 and over lower deflection pulleys 51, 52 to a bottom of the counter weight 41. The lower traction belt 43 may comprise a cogging mating with a corresponding cogging in the drive pulley 63 and the lower deflection pulley 52. The car 10 and the counter weight 41 are connected with the suspension rope 42 and the traction belt 43 so that a closed loop is formed. The lower deflection pulley 51 is positioned above the drive pulley 63 and ensures that the wrap angle of the traction belt 43 around the drive pulley 63 is big enough, advantageously in the order of 90 to 180 degrees.

The lifting machinery 60 may be attached on pivot arms, whereby turning of the lifting machinery 60 around the pivot points moves the drive pulley 63 and thereby affects the tension of the suspension rope 42 and the traction belt 43.

The car 10 and the counter weight 41 are moved in synchronism in opposite directions in the vertically Z extending elevator shaft 20. Rotation of the drive pulley 63 clockwise results in that the car 10 moves upwards and the counter weight 41 moves downwards and vice a versa. The machinery brake 64 stops the rotation of the drive pulley 63 and thereby the movement of the elevator car 10.

The sling 11 may in the same way as in the first embodiment be supported with gliding means 27 on guide rails 25 being attached with brackets 26 to the side walls 21 of the shaft 20.

Figure 4:
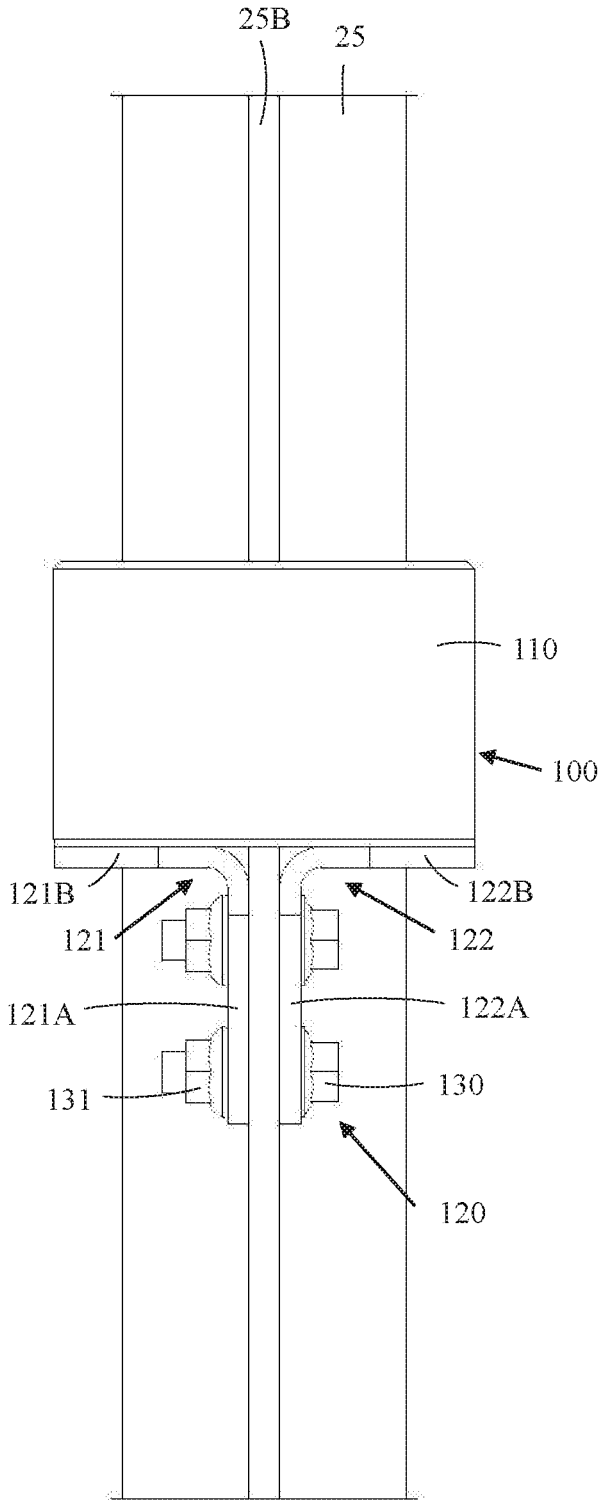
FIG. 4 shows a perspective view of a stop block on a guide rail.
Figure 5:
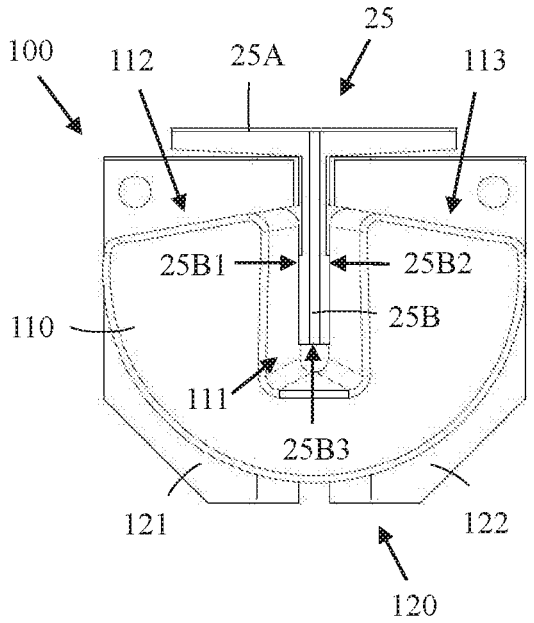
FIG. 5 shows a perspective cross section of the stop block.
Figure 6:
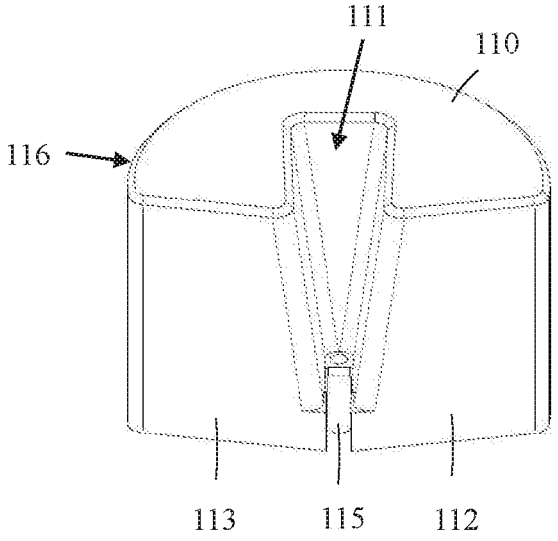
FIG. 6 shows a further perspective view of the buffer of the stop block.

FIG. 4 shows a perspective view of a stop block on a guide rail, FIG. 5 shows a perspective cross section of the stop block, and FIG. 6 shows a further perspective view of the buffer of the stop block.

A horizontal cross section of the guide rail 25 has the shape of a letter T. The T has a base portion 25A and a guide portion 25B extending outwards from the base portion 25A. The base portion 25A of the T is attached with brackets 26 to a wall 21 in the shaft 20. The guide portion 25B has a generally rectangular shape with two opposite side surfaces 25B1, 25B2 and a front surface 25B3 forming guide surfaces for the gliding means 27.

The stop block 100 comprises a buffer 110 and a bottom plate 120. A lower end of the buffer 110 is attached to the bottom plate 120.

A horizontal cross section of the buffer 110 may have a shape of a circle with a cut off segment. The cut off segment leaves a plane surface between an upper end and a lower end of the buffer 110. A slot 111 extends into the buffer 110 from a middle point of the plane surface dividing the plane surface into two plane surfaces 112, 113. A solid neck is left between a bottom of the slot 111 and a curved outer surface 116 of the buffer 110. The slot 111 receives the guide portion 25B of the guide rail 25. The guide portion 25B of the guide rail 25 becomes thus enclosed within the buffer 110.

A horizontal cross section of the buffer 110 may on the other hand have a shape of a rectangle with rounded corners. A slot 111 extends into the buffer 110 from a middle point of a first side surface of the rectangle dividing the first side surface into two separate side surfaces. A solid neck is left between a bottom of the slot 111 and a second side surface opposite to the first side surface of the buffer 110. The slot 111 receives the guide portion 25B of the guide rail 25. The guide portion 25B of the guide rail 25 becomes thus enclosed within the buffer 110.

The slot 111 in the buffer 110 may have a funnel shape so that the upper end of the slot 111 is wider compared to the lower end of the slot 111. The lower end of the slot 111 may be dimensioned so that it fits tightly on the side surfaces 25B1, 25B2 of the guide portion 25B of the guide rail 25. A channel 115 in the form of a tube may be provided at the lower end of the slot 111. The channel 115 may be situated at the bottom of the slot 111. The front surface 25B3 of the guide portion 25B of the guide rail 25 extends to a distance from the bottom of the slot 111. The lubrication medium used in the gliding means 27 flows downward on the guide rail 25 and further into the slot 111 in the buffer 110. The lubrication medium may be directed within the slot 111 into the channel 115 at the lower end of the slot 111.

The funnel shape of the slot 111 in the buffer 110 is advantageous as it leaves room for the buffer 110 to expand within the slot 111 when the car 10 hits the buffer 110.

The front surfaces 112, 113 of the buffer 110 at each side of the slot 111 may be at a distance from the base portion 25A of the guide rail 25. The front surfaces 112, 113 of the buffer 110 at each side of the slot 111 may further be inclined so that the distance from the inner edges of said front surfaces 112, 113 to the base portion 25A of the guide rail 25 is smaller than the distance from the outer edges of said front surfaces 112, 113. This is advantageous as it leaves room for the buffer 110 to expand within the space between the base portion 25A of the guide rail 25 and the front surfaces 112, 113 of the buffer 110 when the car 10 hits the buffer 110.

The buffer 110 may be made of polyurethane.

The bottom plate 120 comprises two bottom plate portions 121, 122. Each bottom plate portion 121, 122 has the shape of an inverted L comprising a vertical branch 121A, 122A and a horizontal branch 121B, 122B. The vertical branch 121A of the first bottom plate portion 121 is seated against a first side surface of the guide portion 25B of the guide rail 25. The vertical branch 122A of the second bottom portion 122 is seated against an opposite second side surface of the guide portion 25B of the guide rail 25. The horizontal branch 121B, 122B of each bottom plate portion 121, 122 extends outwards from the respective side surface of the guide portion 25B of the guide rail 25. The horizontal branch 121B, 122B of each bottom plate portion 121, 122 supports the buffer 110. The vertical branches 121A, 122A of each bottom plate portion 121, 122 and the guide portion 25B of the guide rail 25 are provided with holes. Horizontally directed bolts 130 pass through to the holes in the vertical branches 121A, 122A of each bottom plate portion 121, 122 and in the guide portion 25B of the guide rail 25. The outer ends of the bolts 130 are provided with nuts 131. Tightening of the nuts 131 secures the bottom plate 120 to the guide rail 25.

There vertical branches 121A, 122A of each bottom plate portion 121, 122 are thus at a horizontal distance from each other. Said horizontal distance may be adapted to the thickness of the guide portion 25B of the guide rail 25.

The bottom plate portions 121, 122 may extend beyond the buffer 110. The front edge of the bottom plate portions 121, 122 may extend to the surface of the bottom portion 25B of the guide rail 25. The buffer 110 is attached to the bottom plate portions 121, 122 so that the front surfaces 112, 113 of the buffer 110 are at a distance from the front edges of the bottom plate portions 121A, 122A.

The bottom plate 120 may be made of metal.

The bottom plate 120 may be attached to the buffer 110 during the casting of the buffer 110. Glue may be used in order to ensure the attachment of the two portions 121, 122 of the bottom plate 120 to the buffer 110.

Figure 7:
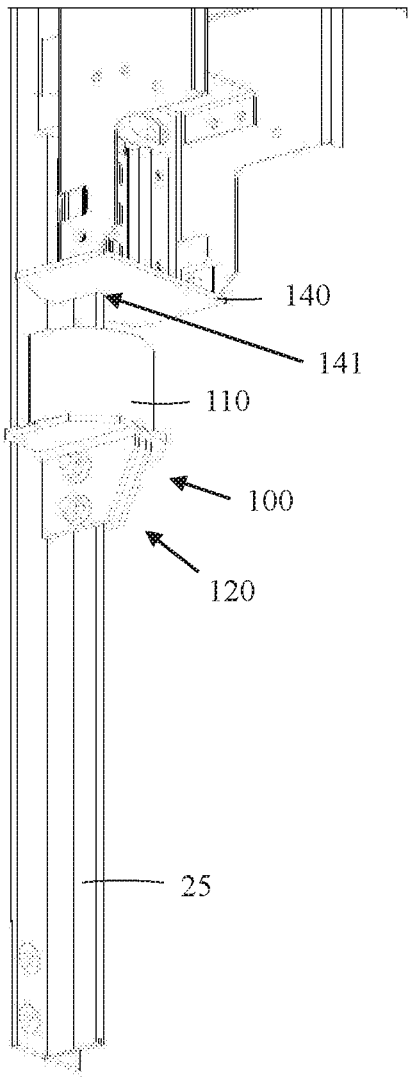
FIG. 7 shows a perspective view of the buffer of the stop block and a first counter plate in the car.

FIG. 7 shows a perspective view of the buffer of the stop block and a first counter plate in the car. The figure shows the guide rail 25, the stop block 100 with the buffer 110 and the bottom plate 120 and a counter plate 140 attached to the frame constructions of the car 10. The counter plate 140 seats against the upper surface of the buffer 110 when the car 10 reaches the lowermost position in the shaft 20. The counter plate 140 comprises a slot 141 receiving the guide portion 25B of the guide rail 25. The counter plate 140 serves also as a locking element preventing the car 10 from buckling off the rail 25. The counter plate 140 seats on the buffer 110 and may form the lowest part of the car 10. The counter plate 140 may extend only a small distance in the horizontal direction beyond the buffer 110.

Figure 8:
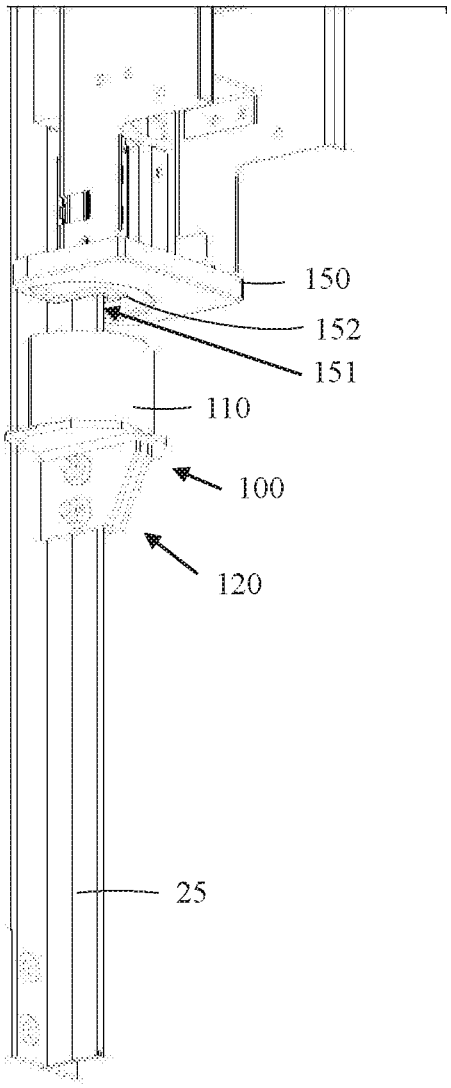
FIG. 8 shows a perspective view of the buffer of the stop block and a second counter plate in the car.

FIG. 8 shows a perspective view of the buffer of the stop block and a second counter plate in the car. The figure shows the guide rail 25, the stop block 100 with the buffer 110 and the bottom plate 120 and a counter plate 150 attached to the frame constructions of the car 10. The counter plate 150 seats against the upper surface of the buffer 110 when the car 10 reaches the lowermost position in the shaft 20. The counter plate 150 comprises a slot 151 receiving the guide portion 25B of the guide rail 25. The counter plate 150 serves also as a locking element preventing the car 10 from buckling off the rail 25. The lower surface of the counter plate 150 has in this embodiment a recess 152 into which the upper end of the buffer 110 fits. This recess 152 prevents buckling of the buffer 110. The counter plate 150 may extend only a small distance in the horizontal direction beyond the buffer 110.

Figure 9:
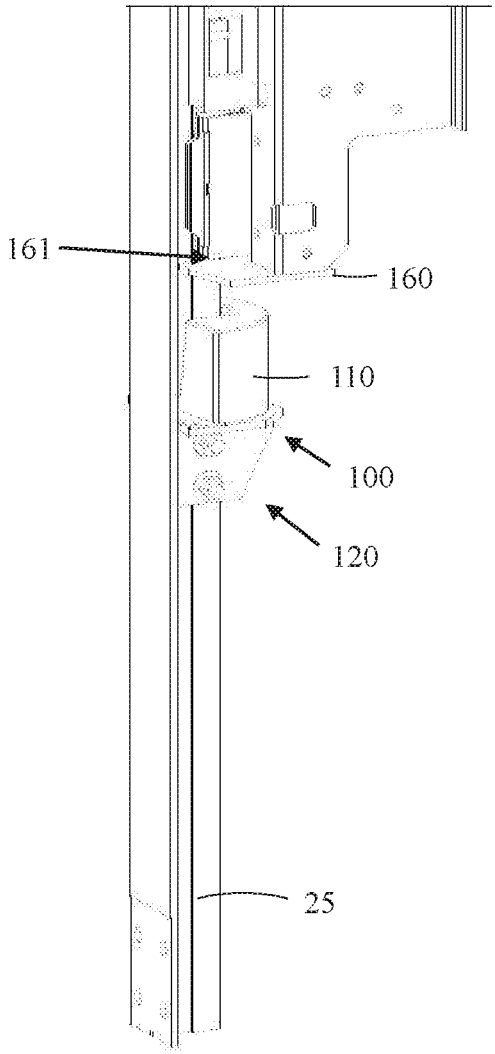
FIG. 9 shows a perspective view of the buffer of the stop block and a third counter plate in the counterweight.

FIG. 9 shows a perspective view of the buffer of the stop block and a third counter plate in the counterweight. The figure shows the guide rail 25, the stop block 100 with the buffer 110 and the bottom plate 120 and a counter plate 160 attached to the frame constructions of the counterweight 41. The counter plate 160 seats against the upper surface of the buffer 110 when counterweight 41 reaches the lowermost position in the shaft 20. The counter plate 160 comprises a slot 161 receiving the guide portion 25B of the guide rail 25. The counter plate 160 serves also as a locking element preventing the counterweight 41 from buckling off the rail 25.

Figure 10:
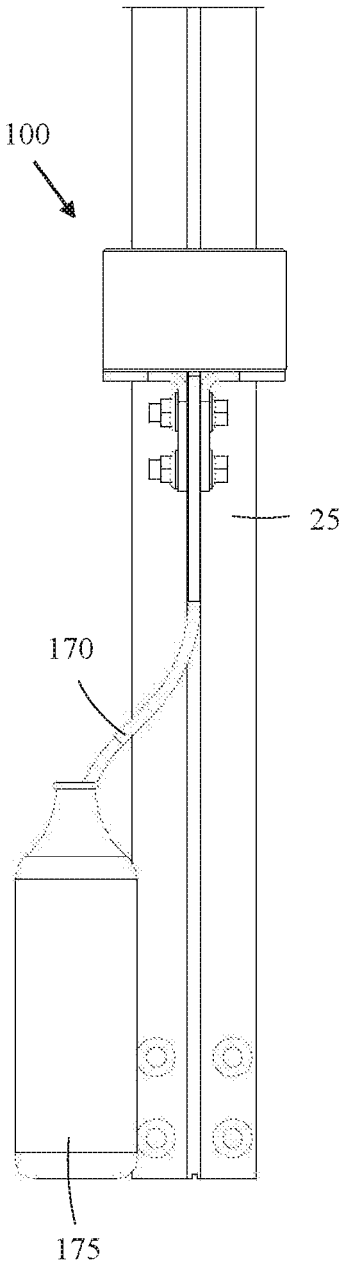
FIG. 10 shows a perspective view of a first lubrication collection system.

FIG. 10 shows a perspective view of a first lubrication collection system. The lubrication collection system may comprise pipe 170 and a container 175. A first end of the pipe 170 may be connected to the channel 115 at the lower end of the slot 111 and a second end of the pipe 170 may be connected to the container 175. The container 175 may be a bottle. The lubrication medium may flow downwards based on gravity to the container 175.

Figure 11:
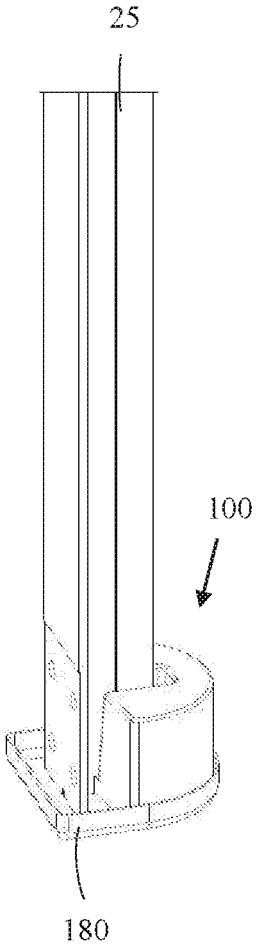
FIG. 11 shows a perspective view of a second lubrication collection system.

FIG. 11 shows a perspective view of a second lubrication collection system. The lubrication system may comprise a container 180 positioned between the lower end of the buffer 110 and the bottom plate 120. The lubrication medium flows from the slot 111 directly down to the container 180. The container 180 may be provided with an opening adapted to the form of the guide rail 25. There edges of the opening may be provided with a seal in order to seal the container 180 to the guide rail 25. The outer edge of the container 180 may be provided with an upwards bended edge. An open space is thus formed within the outer edge of the container. The lubrication may be collected into said open space.

Figure 12:
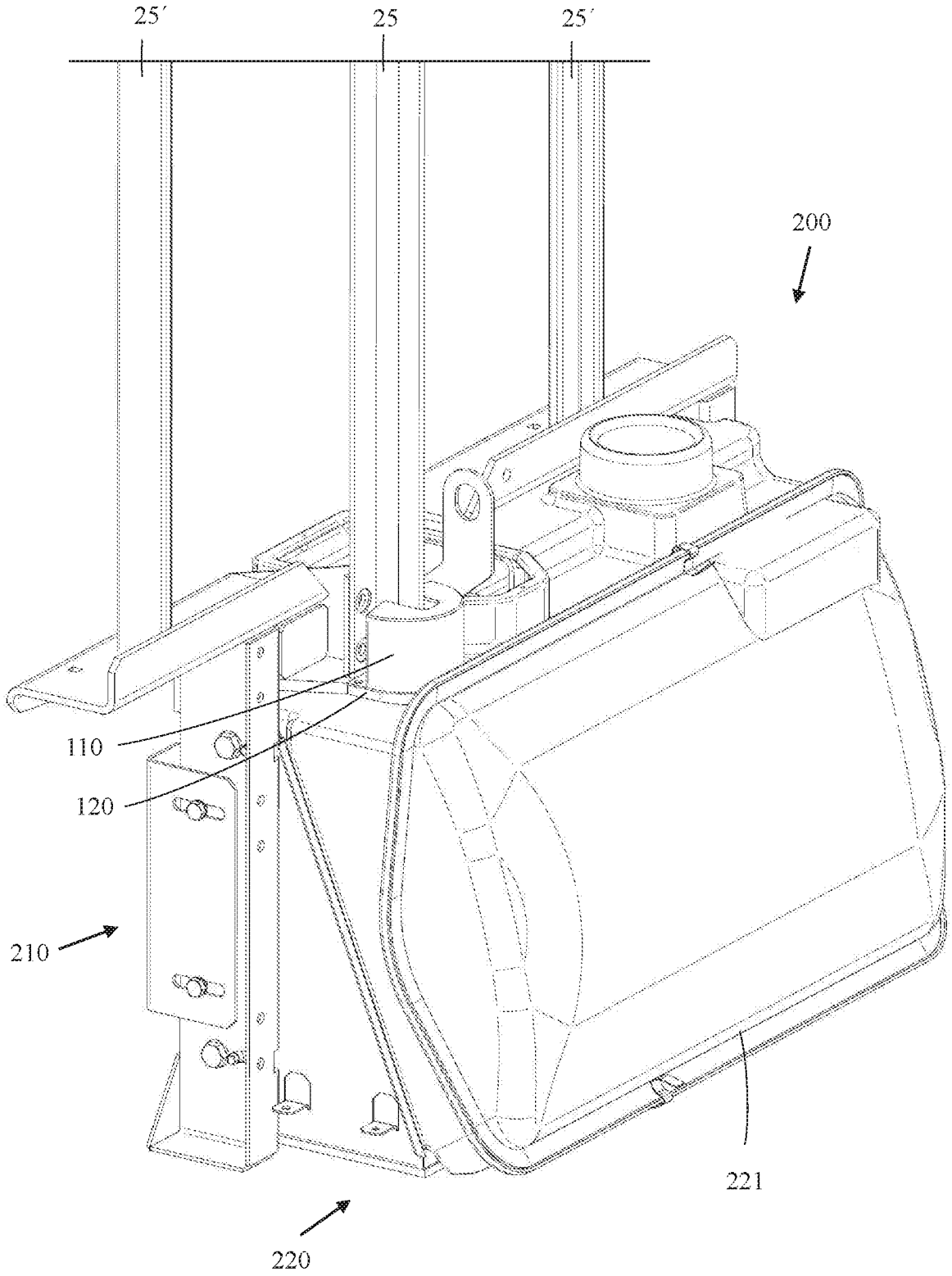
FIG. 12 shows a perspective view of a lifting station in a bottom driven elevator.

FIG. 12 shows a perspective view of a lifting station in a bottom driven elevator. The lifting station 200 is positioned at a floor of the pit of the shaft. The car guide rail 25 is supported on the frame construction 210 of the lifting station 200. The buffer 110 may be supported on the same bracket 120 as the car guide rail 25 which is situated on same side of the shaft as the lifting station 200. This bracket 120 may form the bottom plate of the buffer 110. The figure shows also the guide rails 25' of the counterweight 41 behind the guide rail 25 of the car 10. The other guide rail 25 of the car 10 is not shown in the figure. The lifting machinery 60 is positioned within a casing 220. There are openings at the top of the casing 220 so that the traction belt 43 can pass around the drive pulley 63 positioned in the casing 220. The casing 220 comprises a stationary portion and a removable cover 221. Removal of the cover 221 provides access into the lifting machinery 60 positioned in the casing 220.

The bottom plate 120 in the figures comprises two bottom plate portions 121, 122, whereby each bottom plate portion 121, 122 comprises two branches 121A, 121B, 122A, 122B. This is an advantageous embodiment of the bottom plate 120, but the bottom plate 120 is not restricted to this embodiment. The bottom plate 120 in FIG. 12 may comprise a single sheet attached to the lower end of the buffer 110, whereby the bottom plate 120 is seated on the frame structure 210. The bottom plate 120 may be of any form and construction. The bottom plate 120 may be attached to the guide portion 25B of the guide rail 25 and/or to the base portion 25A of the guide rail 25.

The form of the buffer 110 is not restricted to the form shown in the figures. A horizontal cross section of the buffer 110 may be circular or curved with a cut off segment, elliptical with a cut off segment, rectangular with or without rounded corners, trapezoidal with or without rounded corners, polygonal with or without rounded corners. An essential feature of the buffer 110 is the slot 111 receiving the guide portion 25B of the guide rail 25. The buffer 110 surrounds the three guide surfaces of the guide portion 25B of the guide rail 25. The guide portion 25B of the guide rail 25 becomes enclosed within the buffer 110.

The use of the invention is not limited to the elevators disclosed in the figures, but the invention can be used in any type of elevator e.g. also in elevators lacking a machine room and/or a counterweight. The counterweight could be positioned on either side wall or on both side walls or on the back wall of the elevator shaft. The drive, the motor, the drive pulley, and the machine brake could be positioned in the machine room or somewhere in the elevator shaft. The car guide rails could be positioned on opposite side walls of the shaft or on a back wall of the shaft in a so called ruck-sack elevator.

The stop arrangement can be used on car guide rails and on counterweight guide rails.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator comprising:

a guide rail extending along a height of a shaft, the guide rail including a base portion and a guide portion extending outwards from the base portion, the guide portion including a pair of side facing surfaces and a front surface, a car and/or a counterweight moving upwards and downwards in the shaft and being glidingly supported on the guide portion of the guide rail, a stop block configured to prevent movement of the car and/or the counterweight within the shaft below a level of the stop block, the stop block including, a bottom plate configured to attach via a fastener to the guide portion of the guide rail, and a buffer having an upper surface and a lower surface with respect to a length of the elevator shaft, the lower surface of the buffer seated on the bottom plate such that the bottom plate is below the buffer with respect to the length of the elevator shaft with the buffer fully supported on the guide rail by the bottom plate from the lower surface of the buffer, the buffer including a slot configured to receive the guide portion of the guide rail such that the buffer encloses each of the pair of side facing surfaces and the front surface in the slot.

2. The elevator according to claim 1, wherein the bottom plate comprises two bottom plate portions being positioned on opposite side-facing surfaces of the guide portion of the guide rail.

3. The elevator according to claim 2, wherein each bottom plate portion comprises a vertical branch configured to seat against the side-facing surface of the guide portion of the guide rail and a horizontal branch extending outwards from the side-facing surface of the guide portion of the guide rail, whereby the buffer is seated on the horizontal branches of the bottom plate portions.

4. The elevator according to claim 3, wherein the bottom plate is configured to attach to the guide rail with bolts passing through openings in the vertical branch of each bottom plate portion and through corresponding openings in the guide rail, an outer end of each bolt being provided with a nut for securing the bottom plate to the guide rail.

5. The elevator according to claim 4, wherein the slot extends into the buffer from a middle point of a plane surface formed at a cut off segment, a solid neck being left between a bottom of the slot and a curved outer surface of the buffer.

6. The elevator according to claim 1, wherein the slot in the buffer has a funnel shape so that an upper end of the slot is wider than a lower end of the slot.

7. The elevator according to claim 6, wherein the lower end of the slot is dimensioned so that it fits tightly on the side-facing surfaces of the guide portion of the guide rail.

8. The elevator according to claim 1, wherein a channel includes a tube at a lower end of the slot and configured to direct a lubrication medium into the slot and further into the channel at the lower end of the slot, said lubrication medium being used in gliding means supporting the car glidingly on the guide rail and flowing downwards along the guide rails.

9. The elevator according to claim 1, wherein a front edge of the guide portion of the guide rail extends to a distance from a bottom of the slot.

10. The elevator according to claim 1, wherein an upper surface of the buffer is configured to engage a counter plate seating of the car when the car reaches a lowermost position in the shaft.

11. The elevator according to claim 10, wherein the counter plate comprises a counter plate slot configured to receive the guide portion of the guide rail.

12. The elevator according to claim 10, wherein the counter plate forms the lowest part of the car near the guide rail, said counter plate is configured to seat against the upper surface of the buffer when the car hits the buffer.

13. The elevator according to claim 1, wherein the buffer is made of polyurethane.

14. The elevator according to claim 1, wherein the bottom plate is made of metal.

15. The elevator according to claim 1, wherein the buffer is seated on a horizontal branches of the bottom plate extending outwards from the side-facing surface of the guide portion of the guide rail.

16. The elevator according to claim 1, wherein the fastener is configured penetrate through the guide portion of the guide rail to attach the bottom plate to the guide portion of the guide rail.

17. The elevator according to claim 1, wherein the slot is configured to extend from the upper surface of the buffer to the lower surface of the buffer such that the slot gradually tapers from the upper surface of the buffer to the lower surface of the buffer.

* * * * *